US005303652A

United States Patent [19]

Gasparrini et al.

[11] Patent Number: 5,303,652

[45] Date of Patent: Apr. 19, 1994

[54] SPRAY BLANKET CLEANING SYSTEM

[75] Inventors: Charles R. Gasparrini, Portchester, N.Y.; Carl Arnolds, Stamford, Conn.

[73] Assignee: Baldwin Technology Corporation, Stamford, Conn.

[21] Appl. No.: 48,342

[22] Filed: Jan. 22, 1993

Related U.S. Application Data

[63] Continuation of Ser. No. 836,183, Feb. 13, 1992, abandoned.

[51] Int. Cl.[5] ..... B41F 35/06

[52] U.S. Cl. ..... 101/425; 101/147; 101/366; 239/61; 239/551

[58] Field of Search ..... 101/147, 148, 363, 423, 101/424, 425, 364, 366; 239/61, 142, 416.1, 416.3, 417.5, 428, 550, 551, 562

[56] References Cited

U.S. PATENT DOCUMENTS

| | | | |
|---|---|---|---|
| 3,139,028 | 6/1964 | Huebner | 101/147 |
| 3,355,324 | 11/1967 | Catzen | 101/424 |
| 3,486,448 | 12/1969 | Anderson et al. | 101/425 |
| 3,508,711 | 4/1970 | Switall | 239/562 |
| 4,686,902 | 8/1987 | Allain et al. | 101/424 |
| 4,699,668 | 10/1987 | Burns, Jr. | 101/424 |
| 4,757,763 | 7/1988 | MacPhee et al. | 101/425 |

FOREIGN PATENT DOCUMENTS

| | | |
|---|---|---|
| 2826135 | 12/1979 | Fed. Rep. of Germany . |
| 3507210 | 9/1986 | Fed. Rep. of Germany . |
| 2569611 | 9/1984 | France . |
| 8901412 | 2/1989 | PCT Int'l Appl. . |

OTHER PUBLICATIONS

EPO Search Report discussing the above-identified art.

*Primary Examiner*—Edgar S. Burr
*Assistant Examiner*—Christopher A. Bennett
*Attorney, Agent, or Firm*—Morgan & Finnegan

[57] ABSTRACT

A spray blanket cleaning system is provided for removing piling, lint and ink from blanket cylinders in a plurality of web or offset printing presses. Operation is effected by fluid control systems that direct solvent, water and air to spray systems in specific quantities and at specific pressures. The spray systems are point of use systems that mix solvent and water in a tube then eject the mixture to a connecting spray bar. The mixed fluid is then ejected by air pressure through the spray bar as sprayed fluid. The action of the spray in combination with the rotation of the blanket cylinder and the web, is such as to loosen dust, debris and lint from the blanket cylinder and collect it on the web passing out of the system.

5 Claims, 2 Drawing Sheets

SPRAY BLANKET CLEANING SYSTEM

This is a continuation of co-pending application Ser. No. 07/836,183, filed on February 13, 1992, abandoned.

BACKGROUND OF THE INVENTION

This invention relates to cleaning apparatus for printing presses and, in particular, to systems for automatically washing blanket cylinders in offset printing presses.

The need to wash blanket cylinders during an offset web printing process is well established. As printed copy is produced, debris from ink, paper and fountain solution cause the blanket cylinder to become contaminated. After a period of time, the blanket cylinders must be washed with either solvent or a combination of solvent and water to remove this debris. If washing does not occur, print quality will be reduced and the probability that a web will break increases. Several methods are known in the art to wash blanket cylinders.

The hand wash method utilizes manual application of wash fluid by the press crew when the press is stopped. In this method, hand towels are soaked and the blankets physically scrubbed clean of debris. Manual washing of the blanket while the press is operating is also utilized A member of the press crew will clean a specific area of a blanket that is causing print quality to deteriorate. While this technique extends productivity, it is very unsafe because of the high peripheral speed of the blanket cylinder.

It is far safer, more productive and predictable to use automatic blanket cleaners to clean the blanket cylinder at regular intervals while printing. Several automatic methods have been employed to accomplish this. Cloth type systems, described in U.S. Pat. Nos. 4,344,361 and 4,757,763, utilize a disposable cloth that passes over an inflatable pressure pad. The cloth is wetted with wash fluid pressed against the blanket and the cloth is advanced in increments to affect cleaning Brush type systems utilize a rotating brush that is pressed against the blanket. The brush may be wetted with solvent prior to coming in contact with the blanket. Debris that is removed from the blanket to the brush is gathered in a used solvent collection system. Typically the solvent undergoes separation and treatment to remove the debris and collect the solvent.

Spray type systems utilize a spray bar positioned near the blankets. The spray bar sprays wash fluid onto the blanket cylinders. Previously known spray bars, as in U.S. Pat. No. 4,686,902, premix solvent and water in a tank to form an effective emulsified solution. This is undesirable because once the wash solvent is mixed, the ratio of solvent to water in the solution cannot be changed unless the system is drained and flushed and a new ratio established. Additionally, the mixture must be continually circulated or agitated to maintain the emulsification. The present invention avoids the need for mixing water and solvent in a tank or premixer and avoids the need for recirculation or agitation of the wash solvent, thus allowing continual change in the emulsified solution as desired without requiring that the system be drained and flushed.

In other known spray systems, for example German Pat. No. 2,826,135, the amount of wash fluid sprayed by the spray bar is controlled and limited to the volume of the internal cavity of the spray bar. In particular, the system works in cycles, where one cycle consists of completely filling the internal cavity of the spray bar with wash fluid followed by activating the air for spraying. The present invention avoids this cyclic action by providing a means for the wash fluid to be continuously ejected from the spray bar as it enters the spray bar. The present invention also provides for individually settable water and solvent amounts which are not limited to the volume of the internal cavity of the spray bar.

Other problems encountered in conventional cleaning systems include the risk of dryer damage or even explosion caused by the ignition of excessive solvents. Typically when the press is shut down for maintenance or repair the ink roller train becomes tacky from ink residue and debris. If the press is restarted in this condition there is a high risk of web breakage. In order to avoid this breakage, the blanket is prewet manually by a pressman applying solvent to the blanket or adding oil to the roller train to soften the tacky ink. This practice is both hazardous and wasteful because uncontrolled amounts of solvent entering the dryer can result in explosion. Also, the added oil has a deleterious effect on the ink color resulting in paper waste while the oil is dissipated. The present invention avoids this problem by providing a means to automatically prewet the blanket, reducing the risk of explosion from uncontrolled solvent application.

OBJECTS AND STATEMENT OF THE INVENTION

It is, therefore, an object of the present invention to provide an improved spray system for cleaning blanket cylinders during the course of a press run without interrupting press operation or causing excessive waste during the run. This permits a sharper reproduction for a printed product and incurs less down-time. It also permits the use of grades ,of paper stock having higher lint contents.

Another object of the present invention is to utilize a minimal amount of solvent to insure dryer safety.

A further object of this invention is to utilize a point of use mixing system for water and solvent that eliminates the need for recirculation or agitation of the cleaning fluid.

Another object of this invention is to provide for individually settable water amounts and solvent amounts at each printing unit.

Still another object of this invention is to provide for a system that can wash all press units simultaneously or sequentially as selected by suitable control programs.

Another object of this invention is to provide a prewetting feature in the spray blanket cleaner system to preclude web breaks during start-up.

Another object of this invention is to provide for balanced wetting of the web by directing solvent. If the right side of the cylinder is wet before the left side of the cylinder, the web could wander laterally or be subject to uneven tension and break.

In accordance with this invention, generally stated, a spray blanket cleaner system is provided for cleaning blankets on plurality of web or offset printing presses during operation of the press, the system having fluid control systems that dispense solvent, water and air to spray systems in specific quantities and at specific pressures as directed by a control element. The spray blanket cleaner system can be periodically actuated to simultaneously or individually spray the surface of blankets of web press units.

The frequency of the automatic actuation and operation of the spray system of this invention is regulated by the control element and is adjustable by a press operator in response to various anticipated or observed operating parameters such as the length of the press run and the lint content of the paper stock.

The foregoing and other objects, features and advantages of the present system will be apparent to those skilled in the art in light of the following description of preferred embodiments in connection with the accompanying drawings.

DESCRIPTION OF PREFERRED EMBODIMENTS

Figure 1:
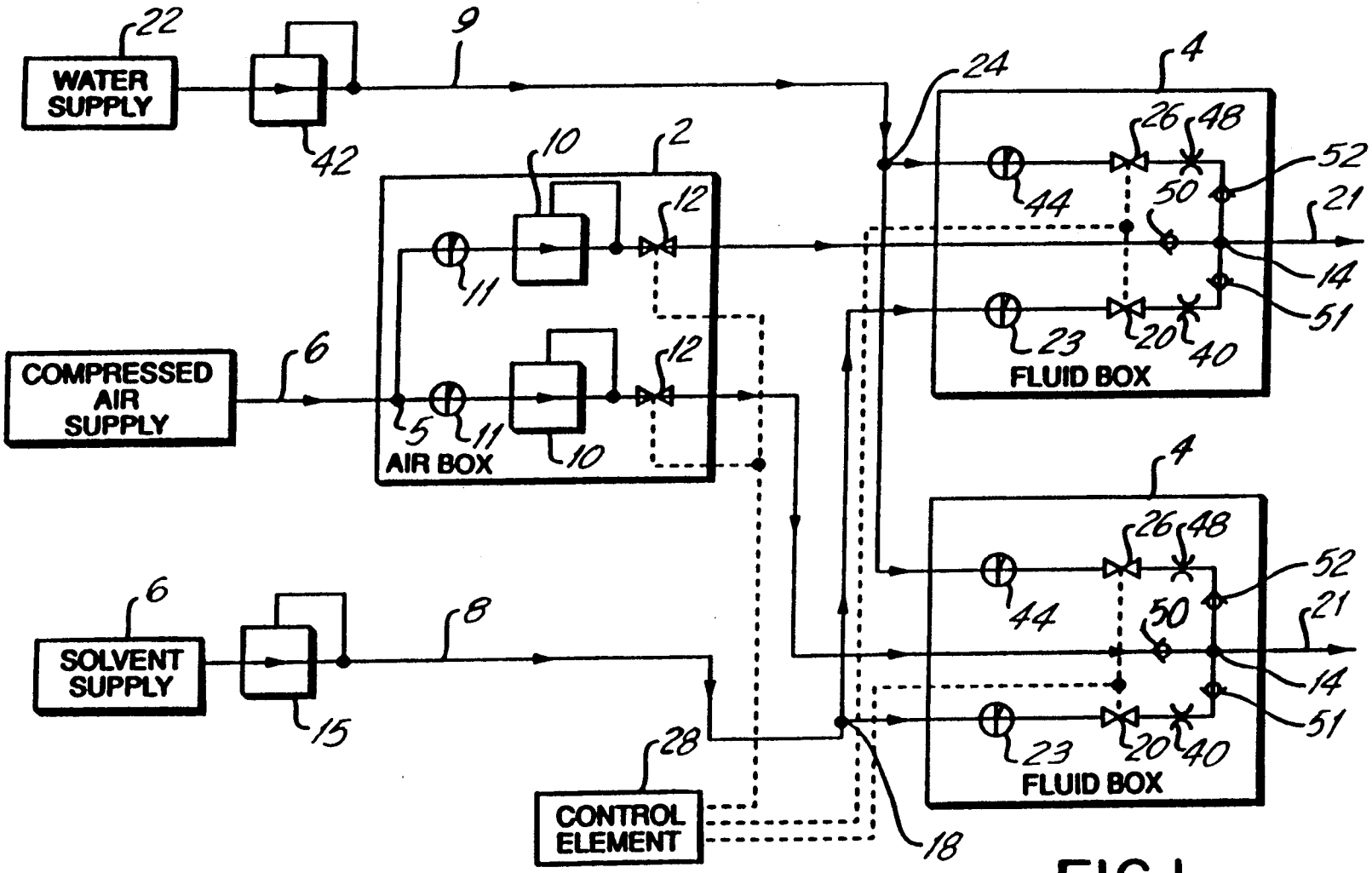
FIG. 1 is a schematic showing the basic fluid flow and control element in accordance with a preferred embodiment of the invention.
Figure 2:
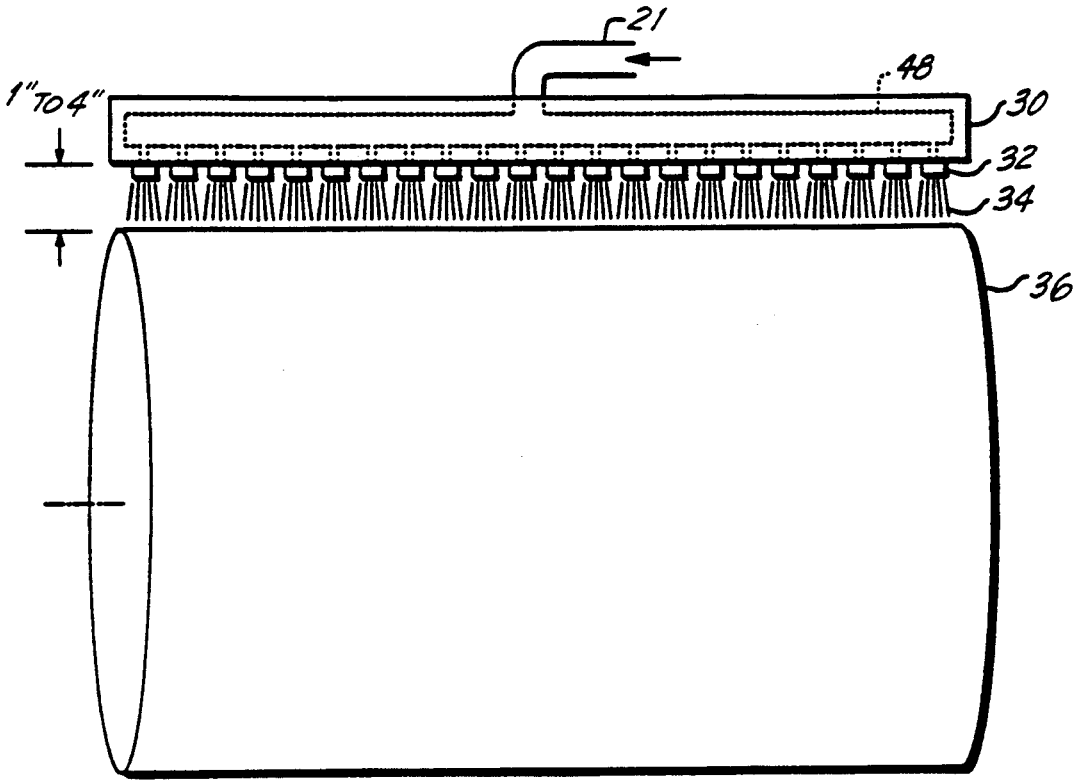
FIG. 2 is a side view of a center feed spray system.

Referring now to the drawings, and, in particular, to FIG. 1, there is shown a fluid control system consisting of two main components; an air box 2 and fluid boxes 4. Each press unit is equipped with one air box 2 and two fluid boxes 4 which control the necessary fluids and air to the spray systems. A center feed spray system is shown in FIG. 2 and an end feed spray system is shown is FIG. 3. The fluid control system regulates solvent, water and air to the spray systems in specific quantities and at specific pressures as directed by a control element 28.

The air box 2 provides regulated air pressure as required for system function. Compressed air enters the air box 2 through line 6 and is supplied to an air valve manifold 5. The air then flows through air filters 11, fluid spray regulators 10 and fluid spray valves 12. When the fluid spray valves are actuated by the control element 28, the regulated air flows out of the air box 2 to the corresponding fluid box 4. It then flows past an air check valve 50, enters a fluid manifold 14 and flows into a mixing tube 21. The air then ejects the mixed solvent and water from the mixing tube 21 into a spray bar 30 (FIGS. 2 and 3).

Pressurized solvent is delivered from a solvent supply 16 through line 8, past a solvent regulator 15, to a solvent manifold inlet 18. The solvent then passes through a solvent filter 23 to a solvent valve 20. When the solvent valve 20 is actuated by the control element 28, the solvent enters the fluid manifold 14 and then flows into the mixing tube 21. Flow control means, such as a solvent orifice 40 and a solvent check valve 51, are interposed between the solvent valve 20 and the fluid manifold 14.

Pressurized water is delivered from a water supply 22 through line 9, past a water regulator 42, to a water manifold 24. Water then passes through a water filter 44 to a water valve 26. When the water valve 26 is actuated by the control element 28, water enters the fluid manifold 14 and then flows into the mixing tube 21. Flow control means, such as a water orifice 48 and a water check valve 52, are interposed between the water valve 26 and the fluid manifold 14. The water and solvent valves can be actuated either simultaneously or sequentially by the control element 28. The mixing tube 21 can center feed the spray bar 30 as in FIG. 2 or end feed the spray bar 30 as in FIG. 3.

Figure 3:
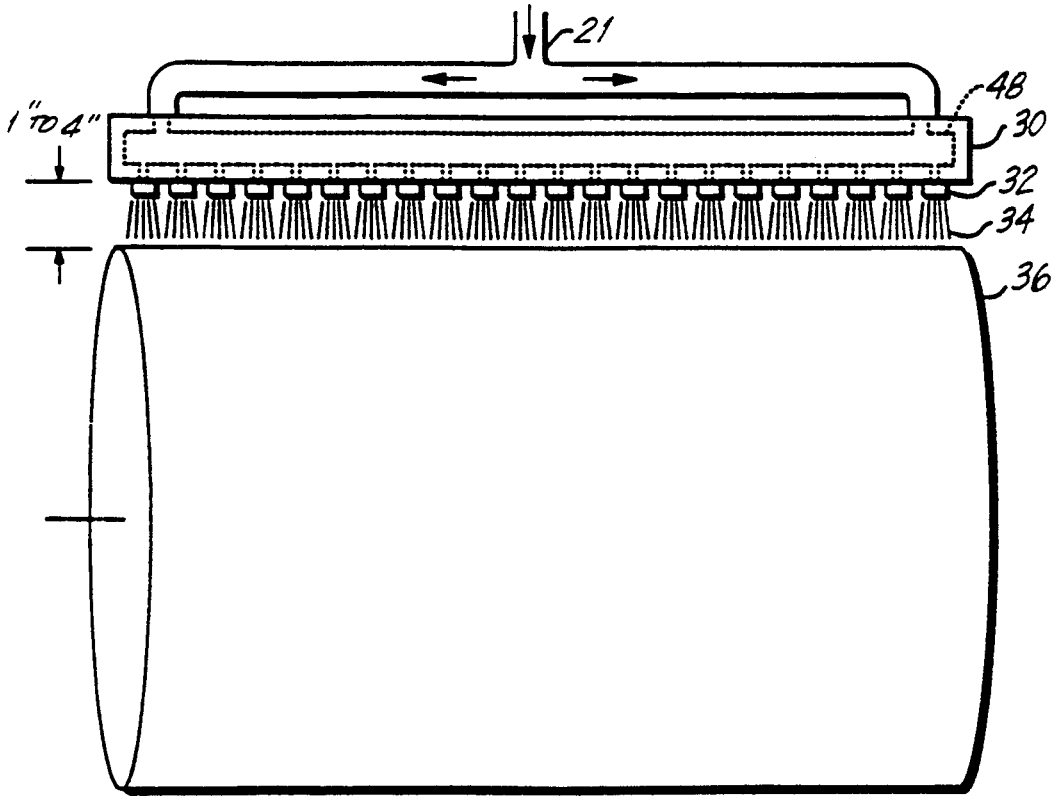
FIG. 3 is a side view of an end feed spray system.

In FIGS. 2 and 3, the water and solvent mixture is ejected by air pressure through the mixing tube 21 into the spray bar 30. The mixed wash fluid is then ejected as sprayed fluid through nozzles 32 in the spray bar 30. This point of use mixing eliminates the need to keep the two fluids constantly moving. The point of use mixing also eliminates prefilling the spray bar, since the wash fluid flows through the spray bar and is ejected from the spray bar simultaneously. The nozzles 32 on the spray bar 30 are purged after use by the air pressure to prevent blockage.

The spray bar 30 is normally positioned adjacent the blanket cylinder 36 on the infeed side of the press unit. The spray bar 30 has a plurality of nozzles 32, preferably eight or more and most preferably fifteen or more. By positioning the nozzles 32 at a relatively short distance, preferably about one to about four inches, from the blanket cylinder 36, spray fans 34 from the nozzles 32 overlap on the blanket 36. The plurality of nozzles 32 permits the positioning of the spray bar 30 close to the blanket cylinder while maintaining spray fan overlap. Placing the spray bar 30 close to the blanket diminishes the amount of solvent lost to mist in the atmosphere in the press room and reduces the amount of solvent required.

The spray bar 30 includes an internal cavity 48 connected to the plurality of nozzles 32. The internal cavity is dimensioned such that the pressurized wash mixture is dispensed approximately equally from the plurality of nozzles. For example, the internal cavity 48 would have a diameter of about one-eighth to about three-sixteenths of an inch when using 25 to 45 pounds per square inch of pressure.

The control element 28 may control the wash cycle for one or more press units. The control element can be operated in an automatic or manual mode. The automatic mode is used for automatic washing of the press blankets. The programs employed by the microprocessor control element regulate at least the ratio of solvent to water used, the pressure of the spray and the duration of the spray. The control element also provides for prewetting of blankets during start-up. With more than one press unit, the control system provides for simultaneous or sequential washing of the blankets.

The foregoing is considered as illustrative only of the principles of the present invention and is not limited to the particular embodiments discussed herein. Various changes, substitutions and modifications may be made thereto by those skilled in the art without departing from the spirit or scope of the invention defined by the appended claims.

What is claimed is:

1. A spray blanket wash system, for applying a mixture of solvent and water to blanket cylinders of printing press units, said system comprising:

(a) a solvent supply means;

(b) a water supply means;

(c) an air supply means;

(d) a mixing tube for mixing solvent, water, and air separately supplied from said solvent supply means, said water supply means, and said air supply means;

(e) a solvent control means, connected with said solvent supply means, including solvent valve means for controlled dispensing of solvent into said mixing tube;

(f) a water control means, connected with said water supply means, including water valve means for controlled dispensing of air to said mixing tube;

(g) air control means, connected with said air supply means, including air valve means for controlled dispensing of air to said mixing tube;

(h) microprocessor control means, connected to said solvent, water and air control means, so as to permit specific ratios of solvent and water to be delivered to said mixing tube, said solvent, water and air mixed in said mixing tube, and to permit controlled duration expulsion of said solvent and water by said air; and (i) spray bar means connected to said mixing tube for receiving and distributing said solvent and water, said spray bar including a plurality of nozzles, for spraying said solvent and water and directing same onto said blanket cylinders.

2. Amended a system as defined in claim 1 wherein said mixing tube center feeds into said spray bar.

3. Amended a system as defined in claim 1 wherein said mixing tube end feeds into said spray bar.

4. A system as defined in claim 1 wherein said plurality of nozzles consists of fifteen or more nozzles on said spray bar.

5. Amended a system as defined in claim 4 wherein said spray bar is located about one to about four inches from said blanket.

* * * * *

UNITED STATES PATENT AND TRADEMARK OFFICE

CERTIFICATE OF CORRECTION

PATENT NO. : 5,303,652

DATED : April 19, 1994

INVENTOR(S) : Charles R. Gasparrini, et al

It is certified that error appears in the above-indentified patent and that said Letters Patent is hereby corrected as shown below:

On the title page, item [22] Filed: January 22, 1993 should read --January 7, 1993--.

Signed and Sealed this

Twenty-fifth Day of October, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,303,652

DATED : April 19, 1994

INVENTOR(S) : Charles R. Gasparrini, et al.

It is certified that error appears in the above-indentified patent and that said Letters Patent is hereby corrected as shown below:

Claim 1, column 5, line 3, "of air to" should read —of water to—
Claim 2, column 6, line 4 "Amended a" should read —A—
Claim 3, column 6, line 6, "Amended a" should read —A—
Claim 5, column 6, line 11, "Amended a" should read —A—

Signed and Sealed this

Tenth Day of January, 1995

*Attest:*

Bruce Lehman

BRUCE LEHMAN

*Attesting Officer*

*Commissioner of Patents and Trademarks*